United States Patent [19]

Nicolino

[11] 4,425,021

[45] Jan. 10, 1984

[54] GLASS MOUNTED ELECTRICAL TERMINAL

[75] Inventor: Muzio Nicolino, Vasto, Italy

[73] Assignee: Societa Italiana Vetro Siv S.p.A., Vasto, Italy

[21] Appl. No.: 285,651

[22] Filed: Jul. 21, 1981

[30] Foreign Application Priority Data

Jul. 31, 1980 [IT] Italy ..... 49388 A/80

[51] Int. Cl.[3] ..... H01R 4/02; H01R 4/10

[52] U.S. Cl. ..... 339/275 T; 219/543; 339/278 T

[58] Field of Search ..... 339/275 R, 275 T, 276 F, 339/278 T; 219/543

[56] References Cited

U.S. PATENT DOCUMENTS 3,634,654 1/1972 Peetz et al. ..... 219/543
3,981,556 9/1976 Sabatelli et al. ..... 339/275 T
4,023,008 5/1977 Durussel ..... 219/543
4,246,467 1/1981 Boaz ..... 219/543

FOREIGN PATENT DOCUMENTS 1104595 11/1955 France .
677030 8/1979 U.S.S.R. ..... 339/276 F

*Primary Examiner*—John McQuade
*Assistant Examiner*—Paula Austin
*Attorney, Agent, or Firm*—Ladas & Parry

[57] ABSTRACT

A device for electrically connecting the source of electric power and conductors of a defroster for rear window in automobiles, comprising a plate to be welded on the collector of the defroster and a tail for connection to the power source, staggered with respect to the plane of the plate and having a portion of reduced transversal section. The plate is provided with holes and recesses which allow a welded connection with the conductor, so as to withstand stresses due to deformation possibly caused during the operation of assembling the electrical connections (FIG. 1).

4 Claims, 3 Drawing Figures

GLASS MOUNTED ELECTRICAL TERMINAL

BACKGROUND OF THE INVENTION

This invention refers to a device for electrically connecting the electrical power source and heating conductors incorporated or imbedded in glass sheets, in particular rear window defrosters for automobiles.

It is known that glass sheets, in particular rear windows for automobiles, may be heated electrically in order to eliminate or avoid fogging, by means of resistances incorporated or embedded, for example by means of a serigraphic process, on the glass sheet itself.

The electric current is brought to the heating resistances by means of connection devices applied generally to a strip of conductive material placed on the glass, said connection device being provided with a terminal the transversal cross section of which is constant, for a fixed or movable connection with conducting leads connected to the power supply.

A device of said type is disclosed in U.S. Pat. No. 3,981,556.

It happens, however, that said connecting devices are frequently subject, during assembly operations, to forces applied to the free end, said forces being of variable directions and intensity, as a consequence of the assembly requirements and the experience of the operator.

The stresses generated by said forces, applied when the electrical terminals are connected to the power leads, discharge on the connection welding between the conductive strip and the metal terminals.

As the stresses involved are of extremely variable intensity in function of the assembly necessities, but also depend on the experience of the operator, it may happen at times that the metal plate becomes separated from the surface of the conductive strip to which it had been previously welded.

In particular, uncontrolled torque and tensile stresses applied to the terminal end may be responsible for said separation of the plate.

The tear of the weld damages the conductive strip appreciably, whereby one is forced to disassemble the rear window from the body of the car again.

In order to overcome this disadvantage, particular attention is placed during the operation of welding of the metal terminals to the conductive strip and particularly severe tests are established in order to guarantee the resistance of the weld itself to predetermined values of tension.

However it may happen that being the forces applied, as previously stated, of random varying direction and intensity, the stresses which act on the weld have different values and directions from those for which the resistance of the weld is guaranteed.

As a consequence in some cases, the terminal is torn off and the rear window defroster is damaged.

SUMMARY OF THE INVENTION

It is the object of this invention to eliminate all the above disadvantages by providing a new connection metal terminal, devised so as to have a higher and different effectiveness with regard to resistance to tear.

In order to obtain such object, according to the invention, the electrical connection device is formed by a plate element of symmetric shape with respect to a geometric symmetry axis and by a tail element integral with the plate element and protruding sideways from it in the direction of the axis of symmetry of said plate, said tail element being staggered with respect to the general plane of the plate element, by means of a step area, said tail having a portion of transversal section which is reduced with respect to its full transversal section, which portion is situated between the step area and the free end or point of said tail element, said plate element having also two holes symmetrical with respect to said axis of symmetry, a third hole centered on said axis of symmetry and two recesses symmetrical with respect to said axis of symmetry, said recesses having one side converging towards the axis of symmetry and one rounded profile, which merges into said step area of the tail element, the arrangement of said elements being such that the centers of the two symmetric holes, the curvature centers of the two rounded profiles of the recesses, as well as said step area are substantially aligned all on a line perpendicular to said axis of symmetry, and furthermore the plate element is slightly arched with respect to its welding plane, in order to be at a slight distance with respect to welding plane, in the area which corresponds to the position of said axis of symmetry.

The embodiment of the connecting device, therefore, takes advantage of the following characteristics:

(1) reduction of the tail cross section;
(2) holes on the wings of the base plate;
(3) concavity of the base plate;
(4) an appropriate geometric configuration of the wings of the base plate.

The first characteristic of this invention consists of a reduction of cross section of the tail, starting from the welded surface and for a well determined length. The residual width of the tail must guarantee on one hand the necessary electrical conductivity and on the other hand the desired capacity of deformation with consequent absorption of stresses. The area of less mechanical strength, so obtained, yields to the stresses applied to the tail itself, thus undergoing deformation, said stresses always starting from the free end of the tail of the metal terminal, while stresses acting directly on the welded surface are simultaneously reduced.

The holes formed on the wings of the plate serve the purpose of allowing overflow of the welding filling material so that the latter, cooling down, exerts a rivetting effect, thus contributing to reinforce the resistance to tear of the weld. The arched shape or concavity of the plate allows an increase of the quantity of welding material underneath the plate itself. The use of such concavity noticeably increases resistance to tear.

The particular configuration of the wings of the plate, which converge with their ends towards the connecting tail, further make the stresses applied on the tail itself to be absorbed.

DESCRIPTION OF THE INVENTION

Figure 1:
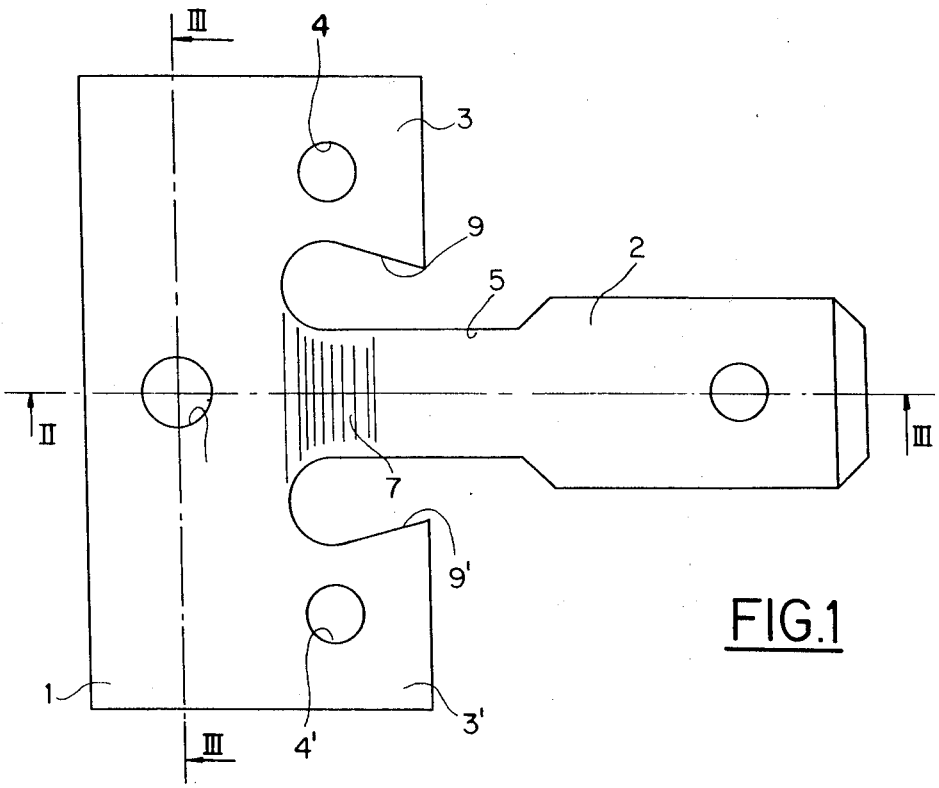
FIG. 1 is a plan top view of the electrical connection device according to the invention.

With reference to the figures, the electrical connection device according to the invention, in one form of embodiment thereof, comprises a base plate 1, which is symmetrical with respect to an axis of symmetry which coincides with the line II—II indicated in FIG. 1.

Said plate 1 is to be welded on the collector of the electrical conductors incorporated on the glass sheet.

Figure 2:
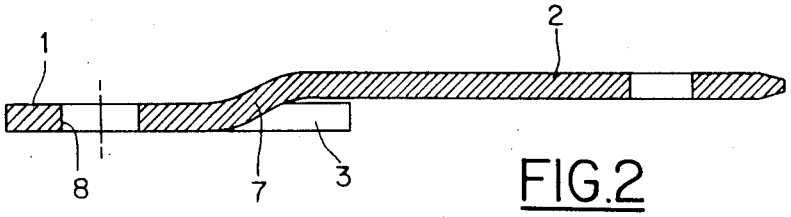
FIG. 2 is a longitudinal cross section along the line II—II of FIG. 1.

From said plate 1, in the direction of said axis of symmetry, a tail 2 extends, which forms the connecting terminal for connection to the conductor coming from the power supply. The tail 2 is staggered with respect to the general plane of plate 1, as shown better in the cross section of FIG. 2, whereby in coincidence of its area of junction to plate 1, tail 2 shows a "step" 7.

According to the invention, tail 2 has a portion 5 of its length the transversal cross section of which is of reduced width with respect to the whole section of the rest of the tail 2. Said reduced cross section portion forms an area of lower resistance apt to absorb the possible stresses applied to the tail during assembly thereof.

The reduction of cross section or width with respect to the rest of the tail, is of about 20 to 40%.

Said cross section reduction is preferably obtained by removing the necessary quantity of material from tail 2, from one side and from the other of its longitudinal axis, in a substantially symmetric way.

Said reduced cross section portion 5 has a length proportional to the length of the terminal itself and, in practical embodiments, such length may be of about 5 to 20 mm.

Therefore the stresses generated by forces which are direct and are applied to the free end of tail 2, particularly torque and tensile stresses, are partially absorbed due to a permanent or elastic deformation of portion 5 of lower resistance and thus discharge with reduced intensity on the welded surface.

The plate 1 is provided with three holes for welding to the conductive strip or collector: of said holes, one indicated in 8 is placed substantially with its center in the previously described axis of symmetry, while the other two holes, indicated in 4 and 4', are formed in wing shaped parts indicated in 3 and 3' of the plate 1. Said wings 3 and 3' are formed in plate 1 by means of recesses 9, 9' which have one side converging in one direction towards the axis of symmetry of the plate itself and which merge in the other direction into the step area 7 of tail 2, through a rounded profile being in the shape of an arch of circumference.

On characteristic of the invention is that the centers of holes 4, 4', the step area 7 and the centers of the radius of curvature of said rounded profile of the recesses 9 and 9', are substantially aligned on a line which is perpendicular to said axis of symmetry of plate 1.

Figure 3:
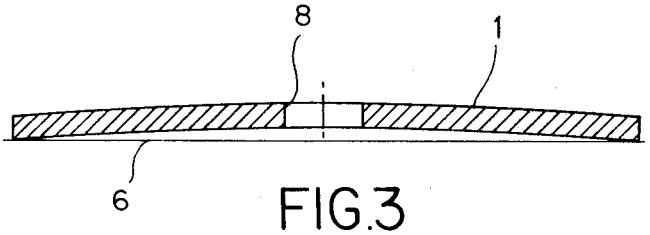
FIG. 3 is a cross section along the line III—III of FIG. 1.

Another characteristic of the invention is that the plate 1 is slightly arched above its welding plane so that it is raised, with respect to the welding plane itself, along said axis of symmetry. The chord of said arch or concavity of the plate may be comprised preferably between 0.3 and 0.4 mm with respect to the welding plane indicated in 6 in FIG. 3. The concavity of plate 1 allows for a larger accumulation of welding filler material, so that the stresses may be easily absorbed thereby. In the case in which the stresses should tend to discharge on the wings, the particular configuration thereof and the rivetting effect of the holes 4, 4' effectively oppose tear. A further advantage obtained through the invention consists in the fact that the resistance of the welding to cyclically acting forces, in case this should be generated, is appreciably increased.

Generally, the device according to the present invention allows to noticeably reduce rejection rates during the operation of assembling car window defrosters.

I claim:

1. An electrical connection device for electrically heated glass sheets, including a plate element of symmetric shape with respect to a geometric axis of symmetry having a hole centered on said axis and a tail element integral with said plate element and protruding sideways from it in the direction of said axis of symmetry of said plate element, said tail element being staggered with respect to the general plane of the plate element, through a step area, said device being characterised in that a portion of said tail element positioned between said step area and the free end of said tail element, has a transversal cross section reduced with respect to the whole transversal cross section of the rest of said tail element and said plate element has two additional holes symmetrically positioned with respect to said axis of symmetry and two recesses symmetrically positioned with respect to said axis of symmetry, having one side converging towards said axis and one rounded profile which merges into said step area of said tail element, the centers of said additional holes, the centers of curvature of said rounded profiles of said recesses and said step area being substantially aligned on a line perpendicular to said axis of symmetry, and said plate element being slightly arched with respect to its general plane so as to be at a slight distance from said general plane in its area corresponding to said axis of symmetry.

2. The device according to claim 1, characterised in that said reduced portion of the tail element has a width which is reduced by 20 to 40% with respect to the entire width of the rest of said tail element.

3. The device according to claim 2, characterised in that the reduction of cross section of the tail element covers a portion of said tail for a length from 5 to 20 mm.

4. The device according to claim 1, characterised in that said plate element is welded over an entire surface thereof.

* * * * *